US009366445B2

(12) United States Patent
Stoia et al.

(10) Patent No.: US 9,366,445 B2
(45) Date of Patent: Jun. 14, 2016

(54) SYSTEM AND METHOD FOR SUPPORTING FUEL NOZZLES INSIDE A COMBUSTOR

(75) Inventors: Lucas John Stoia, Taylors, SC (US); Patrick Benedict Melton, Horse Shoe, NC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1025 days.

(21) Appl. No.: 13/439,973

(22) Filed: Apr. 5, 2012

(65) Prior Publication Data

US 2013/0263604 A1 Oct. 10, 2013

(51) Int. Cl.
*F23R 3/60* (2006.01)

(52) U.S. Cl.
CPC ..... *F23R 3/60* (2013.01); *Y10T 29/4932* (2015.01)

(58) Field of Classification Search
CPC ..... F23R 3/60; F23R 3/283; F23R 3/286; Y10T 29/4932
See application file for complete search history.

(56) References Cited

U.S. PATENT DOCUMENTS

| | | | | |
|---|---|---|---|---|
| 4,100,733 | A * | 7/1978 | Striebel et al. | 60/39.463 |
| 4,408,461 | A * | 10/1983 | Bruhwiler et al. | 60/737 |
| 4,967,561 | A * | 11/1990 | Bruhwiler et al. | 60/737 |
| 5,235,814 | A * | 8/1993 | Leonard | 60/738 |
| 6,672,073 | B2 | 1/2004 | Wiebe | |
| 8,272,224 | B2 | 9/2012 | Cihlar et al. | |
| 8,733,108 | B2 * | 5/2014 | Kim et al. | 60/776 |
| 2010/0077760 | A1 * | 4/2010 | Laster | F23C 7/004 60/742 |
| 2010/0132364 | A1 | 6/2010 | Myers et al. | |
| 2010/0293955 | A1 * | 11/2010 | Berry et al. | 60/742 |
| 2011/0100016 | A1 | 5/2011 | Cihlar et al. | |
| 2012/0045725 | A1 * | 2/2012 | Takiguchi | F23R 3/14 431/60 |

* cited by examiner

*Primary Examiner* — Carlos A Rivera
(74) *Attorney, Agent, or Firm* — Dority & Manning, PA

(57) ABSTRACT

A system for supporting fuel nozzles inside a combustor includes a ring that circumferentially surrounds the fuel nozzles inside the combustor, a support plate that extends radially inside at least a portion of the ring, and a first connection between the support plate and at least one of the fuel nozzles inside the combustor. A second connection is between the support plate and the ring. A method for supporting fuel nozzles in a combustor includes surrounding the fuel nozzles with a ring, connecting a support plate to the ring, and connecting the support plate to at least one fuel nozzle.

13 Claims, 6 Drawing Sheets

SYSTEM AND METHOD FOR SUPPORTING FUEL NOZZLES INSIDE A COMBUSTOR

FIELD OF THE INVENTION

The present invention generally involves a system and method for supporting fuel nozzles inside a combustor.

BACKGROUND OF THE INVENTION

Combustors are commonly used in industrial and power generation operations to ignite fuel to produce combustion gases having a high temperature and pressure. Various competing considerations influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by nozzles, possibly causing severe damage to the nozzles in a relatively short amount of time. In addition, higher combustion gas temperatures generally increase the disassociation rate of diatomic nitrogen, increasing the production of nitrogen oxides (NOX). Conversely, lower combustion gas temperatures associated with reduced fuel flow and/or part load operation (turndown) generally reduce the chemical reaction rates of the combustion gases, increasing the production of carbon monoxide and unburned hydrocarbons.

In a particular combustor design, an end cover or breach end connected to a combustor casing may define a combustor head end, and a cap assembly that extends radially across a portion of the combustor may separate the head end from a combustion chamber. One or more fuel nozzles connected to the breech end in a cantilevered fashion may extend downstream from the breech end to the cap assembly. The fuel nozzles may be radially arranged in the combustor head end to mix fuel with a working fluid prior to combustion in the combustion chamber.

Increasing an axial length and/or volume of the head end allows more time for the fuel and compressed working fluid to mix prior to combustion. The enhanced mixing allows leaner combustion at higher operating temperatures to protect against flashback or flame holding while also controlling undesirable emissions. However, increasing the axial length and/or volume of the head end may lead to harmful combustion dynamics that reduce the useful life of one or more combustor components. For example, increasing the axial length of the head end may result in lower natural frequencies associated with the cantilevered fuel nozzles, leading to high cycle fatigue failure of the fuel nozzles and downstream components. Alternately, or in addition, the combustion dynamics may produce pressure pulses inside the fuel nozzles and/or combustion chamber that affect the stability of the combustion flame, reduce the design margins for flashback or flame holding, and/or increase undesirable emissions. Therefore, an improved system and method for supporting fuel nozzles inside a combustor that increases the natural or resonant frequencies created by the fuel nozzles, improves the high cycle fatigue limits, and/or reduces undesirable combustor dynamics would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supporting fuel nozzles inside a combustor. The system includes a ring that circumferentially surrounds the fuel nozzles inside the combustor, a support plate that extends radially inside at least a portion of the ring, and a first connection between the support plate and at least one of the fuel nozzles inside the combustor. A second connection is between the support plate and the ring.

Another embodiment of the present invention is a combustor that includes a breech end, a casing connected to the breech end and circumferentially surrounding at least a portion of the combustor, and a plurality of fuel nozzles connected to the breech end and extending downstream from the breech end. A ring circumferentially surrounds the fuel nozzles, and a support plate extends radially inside at least a portion of the ring. A first connection is between the support plate and at least one of the fuel nozzles, and a second connection is between the support plate and the ring.

The present invention may also include a method for supporting fuel nozzles in a combustor that includes surrounding the fuel nozzles with a ring, connecting a support plate to the ring, and connecting the support plate to at least one fuel nozzle.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
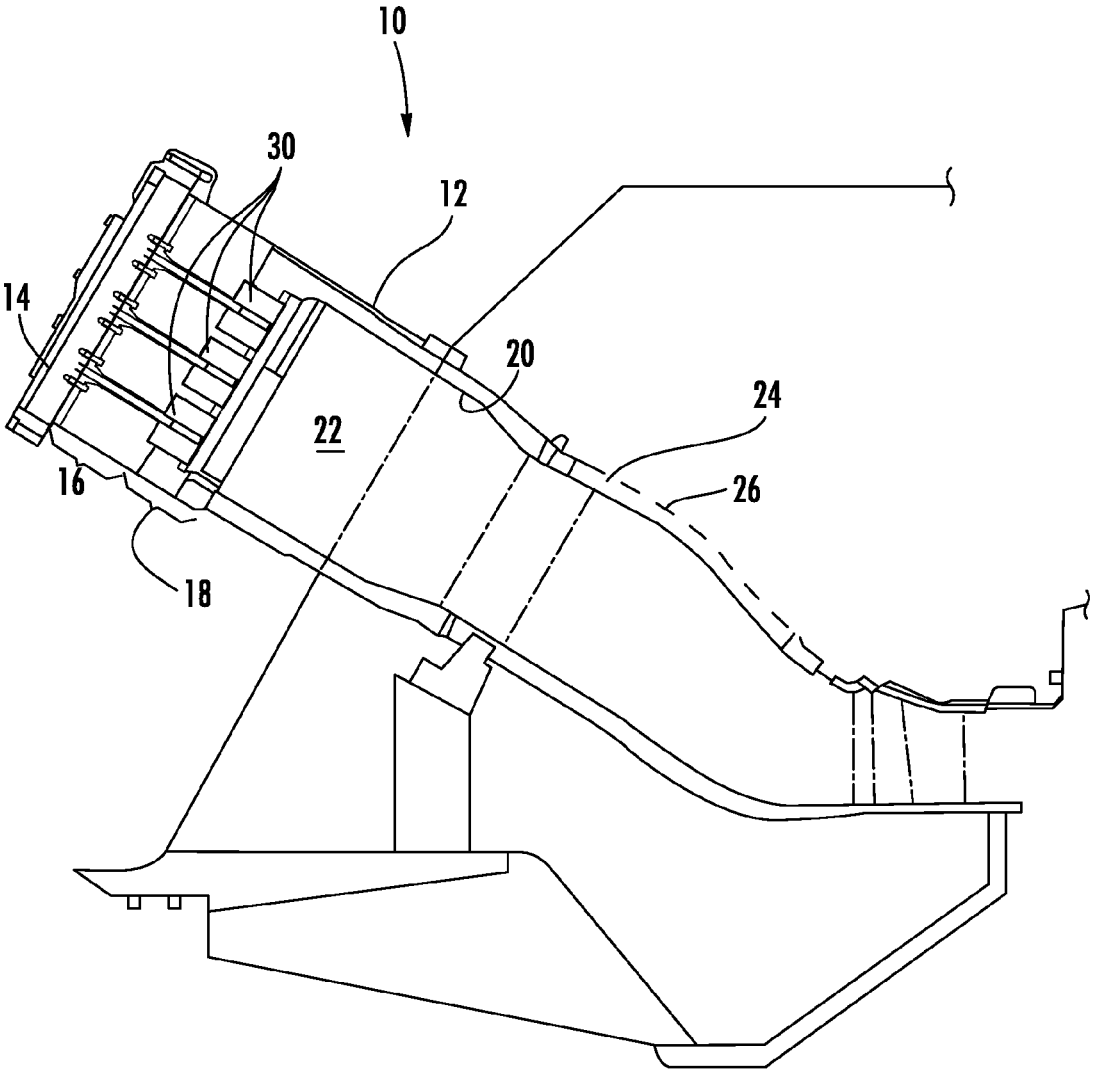
FIG. 1 is a side cross-section view of an exemplary combustor.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for supporting fuel nozzles in a combustor. The system generally includes a ring that circumferentially surrounds the fuel nozzles and a support plate that connects the fuel nozzles to the ring. The ring in turn is connected to the combustor, and in particular embodiments, the ring may be connected to a breech end of the combustor. In other particular embodiments, the support plate may include multiple separate support plates that are each connected to the ring and at least one nozzle. In this manner, the systems and methods described herein may increase the natural or resonant frequencies created by the fuel nozzles, improve the high cycle fatigue limits, and/or reduce undesirable combustor dynamics. Although exemplary embodiments of the present invention will be described generally in the context of a combustor incorporated into a gas turbine for purposes of illustration, one of ordinary skill in the art will readily appreciate that embodiments of the present invention are not limited to a gas turbine unless specifically recited in the claims.

FIG. 1 shows a simplified cross-section view of an exemplary combustor 10, such as would be included in a gas turbine, according to various embodiments of the present invention. The combustor 10 generally includes a casing 12 that circumferentially surrounds at least a portion of the combustor 10 to contain a working fluid flowing to the combustor 10. As shown in FIG. 1, the casing 12 may be connected to or include an end cover or breech end 14 that extends radially across at least a portion of the combustor 10 to provide an interface for supplying fuel, diluent, and/or other additives to the combustor 10. In addition, the casing 12 and breech end 14 may combine to at least partially define a head end 16 inside the combustor 10. A cap assembly 18 downstream from the head end 16 may extend radially across at least a portion of the combustor 10, and a liner 20 connected to the cap assembly 18 may at least partially define a combustion chamber 22 downstream from the head end 16. The working fluid may flow, for example, through flow holes 24 in an impingement sleeve 26 and along the outside of the liner 20 to provide convective cooling to the liner 20. When the working fluid reaches the head end 16, the working fluid reverses direction to flow through the cap assembly 18 and into the combustion chamber 22.

One or more fuel nozzles 30 may extend between the breech end 14 and and the cap assembly 18. The fuel nozzles 30 may be radially arranged in the combustor head end 16 to mix fuel with the working fluid prior to combustion in the combustion chamber 22. As shown in FIG. 1, the fuel nozzles 30 are connected to the breech end 14 in a cantilevered fashion, and the cantilevered attachment results in a resonant or natural frequency associated with the fuel nozzles 30 and/or cap assembly 18 that may be in the frequency range of other vibration sources, causing harmonic vibrations that may lead to damage and/or increased wear. As a result, various embodiments of the present invention include one or more support plates that extend radially inside the cap assembly 18. The support plates brace the fuel nozzles 30 to raise the resonant or natural frequency associated with the fuel nozzles 30 and/or cap assembly 18.

Figure 2:
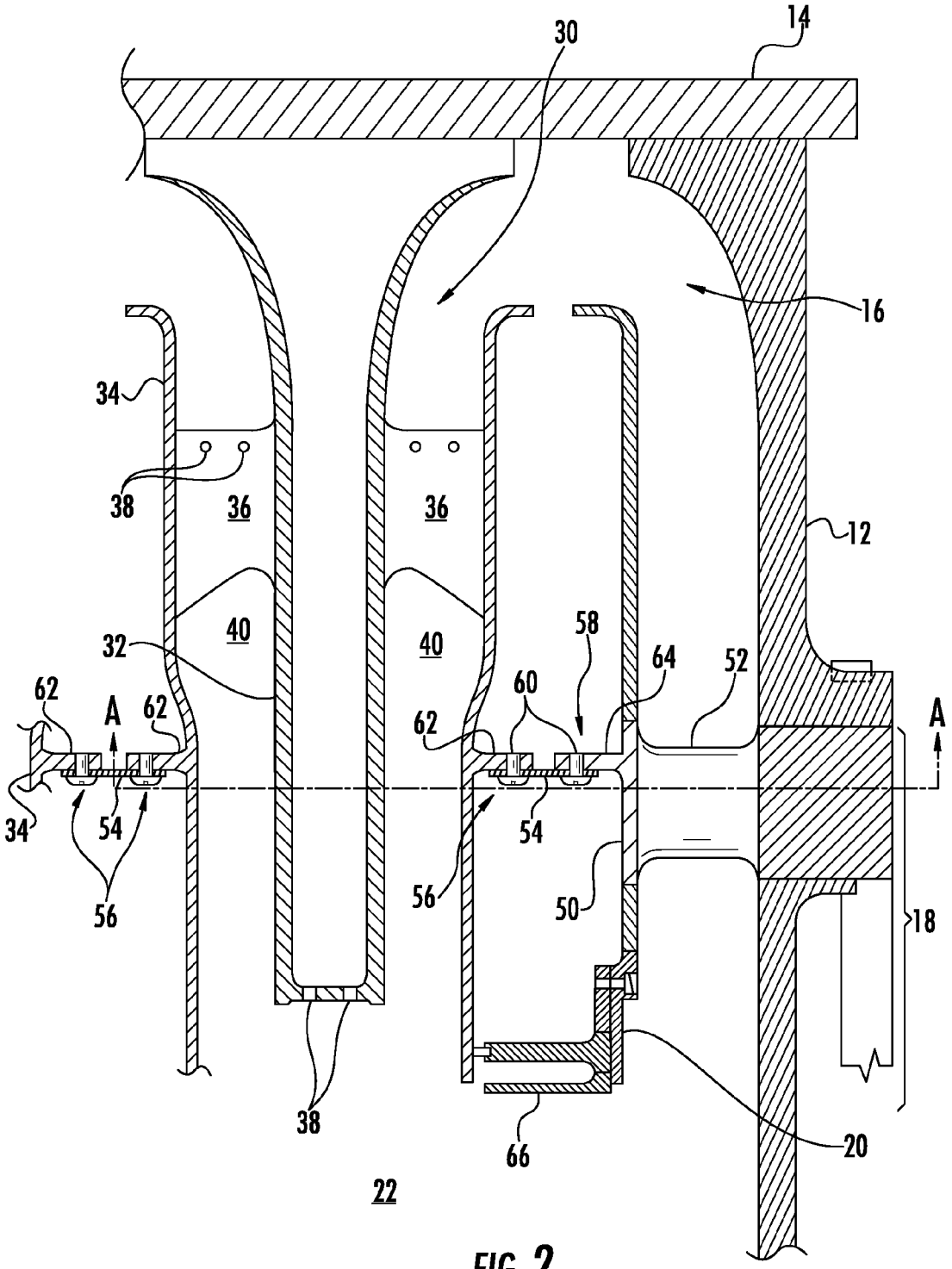
FIG. 2 is a side cross-section view of a portion of a head end of a combustor according to a first embodiment of the present invention.
Figure 3:
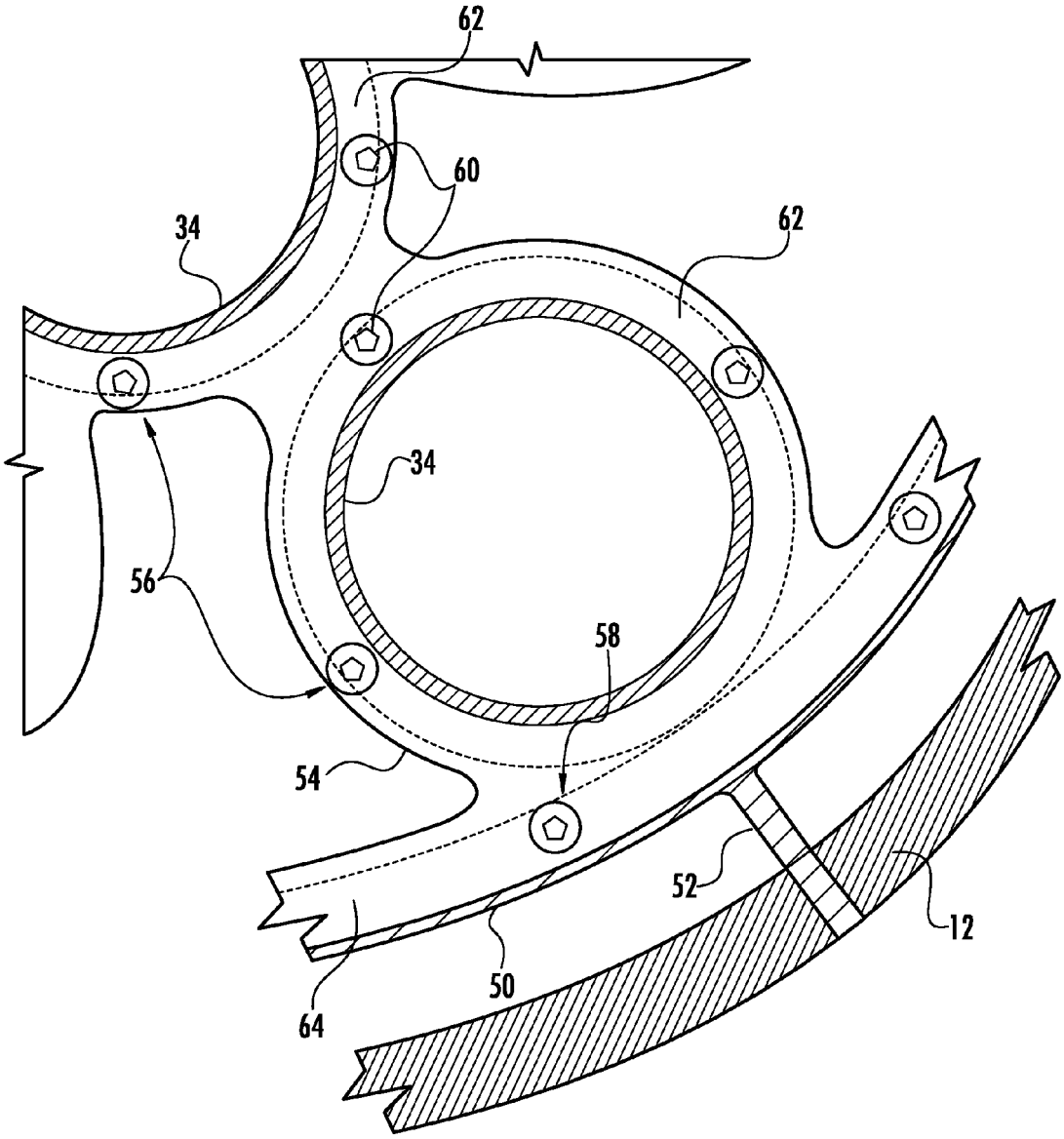
FIG. 3 is an axial cross-section view of the combustor shown in FIG. 2 taken along line A-A.

FIG. 2 provides a side cross-section view of a portion of the head end 16 of the combustor 10 according to a first embodiment of the present invention, and FIG. 3 provides an axial cross-section view of the combustor 10 shown in FIG. 2 taken along line A-A. As shown in FIG. 2, each fuel nozzle 30 may include, for example, a center body 32, a shroud 34 that circumferentially surrounds at least a portion of the center body 32, and one or more vanes 36 that extend radially between the center body 32 and the shroud 34. The center body 32 provides fluid communication for fuel, diluents, and/or other additives to flow from the breech end 14, through the cap assembly 18, and into the combustion chamber 22. For example, fuel, diluents, and/or other additives may flow through the center body 32 and out fuel ports 38 at a downstream end of the center body 32 into the combustion chamber 22. The shroud 34 defines an annular passage 40 between the center body 32 and the shroud 34. The annular passage 40 provides fluid communication for the working fluid to flow through the cap assembly 18 and into the combustion chamber 22. In particular embodiments, the center body 32 may provide fluid communication to one or more of the vanes 36 so that fuel, diluents, and/or other additives may flow through fuel ports 38 in the vanes 36. The vanes 36 may be angled to impart swirl to the fuel and working fluid flowing through the annular passage 40 to enhance mixing between the fuel and working fluid before reaching the combustion chamber 22.

As shown in FIGS. 2 and 3, the cap assembly 18 generally includes a ring 50 that circumferentially surrounds the fuel nozzles 30, and one or more radially extending braces 52 or supports may connect the cap assembly 18 to the casing 12. A support plate 54 inside the cap assembly 18 may extend radially inside at least a portion of the ring 50. For example, as shown most clearly in FIG. 3, the support plate 54 may circumferentially surround each shroud 34 of each fuel nozzle 30 inside the cap assembly 18 and/or rigidly connect to each shroud 34 of each fuel nozzle 30 inside the combustor 10. The support plate 54 may be fabricated from any suitable material capable of continuous exposure to the temperatures associated with the combustor 10. For example, the support plate 54 may be machined from carbon steel, low alloy steel, stainless steel, or another suitable high strength sheet metal plate.

The support plate 54 rigidly connects to both the ring 50 and one or more of the fuel nozzles 30. For example, as shown most clearly in FIG. 2, a first connection 56 between the support plate 54 and the shroud 34 of the fuel nozzle 30 and a second connection 58 between the support plate 54 and the ring 50 enable the support plate 54 to radially support the fuel nozzles 30 inside the cap assembly 18. The first and second connections 56, 58 may include any suitable structure known in the art for fixedly connecting components together. For example, the first and second connections 56, 58 may include weld joints between the support plate 54 and the fuel nozzles 30 and/or ring 50. Alternately, or in addition, as shown in FIGS. 2 and 3, the first and second connections 56, 58 may include bolts 60, screws, or clamps that rigidly connect the support plate 54 to a flange or lugs that extend radially from the shrouds 34 and/or ring 50. In the particular embodiment shown in FIGS. 2 and 3, the shroud 34 surrounding each fuel nozzle 30 includes a flange 62, and the ring 50 surrounding the fuel nozzles 30 also includes a flange 64. However, in alternate embodiments, the flanges 62, 64 may be replaced with lugs or other attachment points for connecting the support plate 54 to the fuel nozzles 30 and ring 50.

As shown in FIGS. 2 and 3, the first and second connections 56, 58 connect the support plate 54 between the fuel nozzles 30 and the ring 50, and the brace 52 anchors or ties the ring 50 to the casing 12. As a result, the combined effect of the ring 50 and the support plate 54 may stiffen the support to the fuel nozzles 30, thereby increasing the natural frequency of the fuel nozzles 30 and/or cap assembly 18. In addition, the location and orientation of the bolts 60 associated with the first and second connections 56, 58 facilitate assembly of the fuel nozzles 30, support plate 54, and ring 50. Specifically, the bolts 60 may be installed and torqued to the desired values before an effusion cap 66 is riveted or otherwise attached to the ring 50 to complete installation of the cap assembly 18 in the combustor 10.

Figure 4:
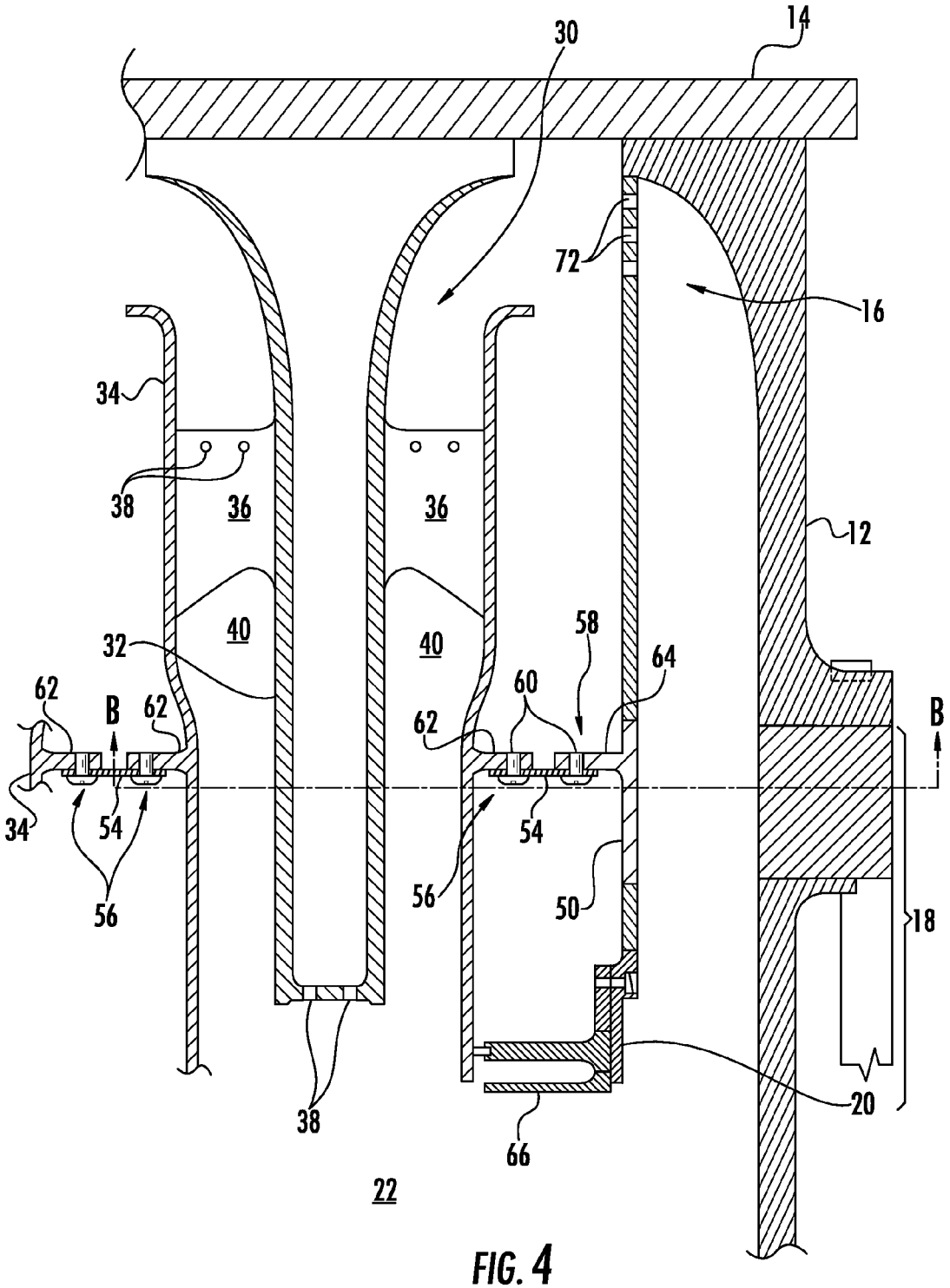
FIG. 4 is a side cross-section view of a portion of a head end of a combustor according to a second embodiment of the present invention.
Figure 5:
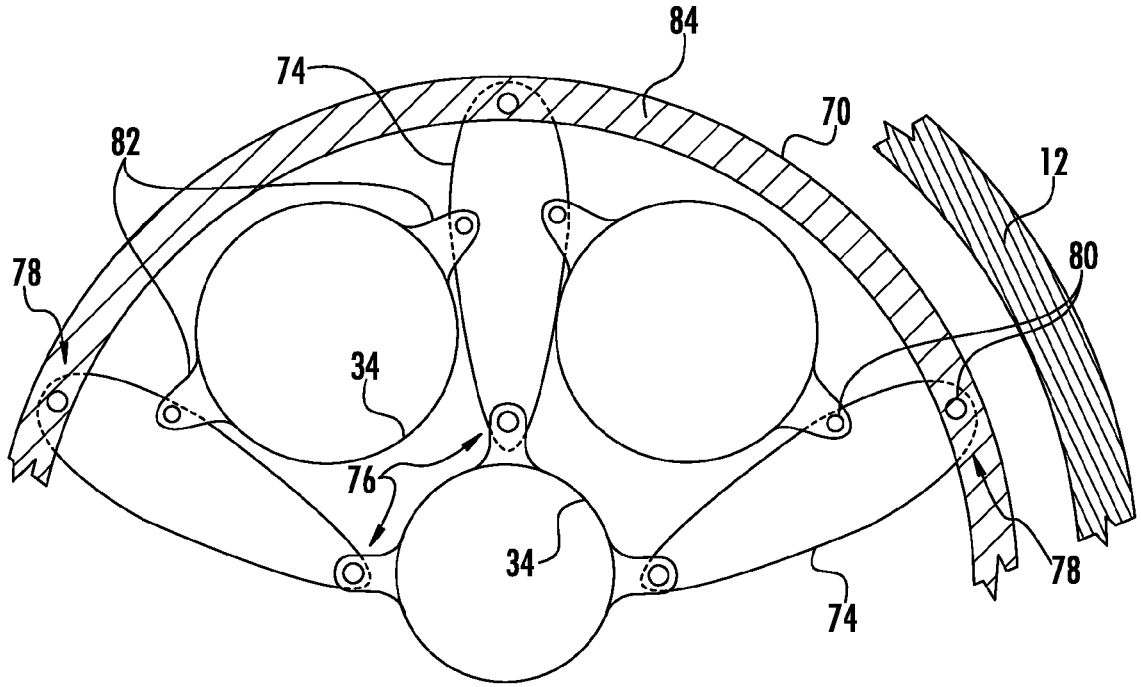
FIG. 5 is an axial cross-section view of the combustor shown in FIG. 4 taken along line B-B.

FIG. 4 provides a side cross-section view of a portion of the head end 16 of the combustor 10 according to a second embodiment of the present invention, and FIG. 5 provides an axial cross-section view of the combustor 10 shown in FIG. 4 taken along line B-B. As shown in FIG. 4, each fuel nozzle 30 may again include the center body 32, shroud 34, vanes 36, fuel ports 38, and annular passage 40 as previously described with respect to FIG. 2. In addition, the cap assembly 18 again generally includes a ring 70 that circumferentially surrounds the fuel nozzles 30. As shown most clearly in FIG. 4, however, the radially extending braces 52 present in the previous embodiment have been removed, and the ring 70 extends axially through the head end 16 and connects to the breech end 14 of the combustor 10. Perforations 72 in the ring allow the working fluid to flow across the ring 70 and into the fuel nozzles 30, as before, while the breech end 14 rigidly supports the ring 70 in place.

The embodiment shown in FIGS. 4 and 5 again includes a support plate 74 inside the cap assembly 18 that extends radially inside at least a portion of the ring 70. As before, the support plate 74 rigidly connects to both the ring 70 and one or more of the fuel nozzles 30. For example, as shown most clearly in FIG. 4, a first connection 76 between the support plate 74 and the shroud 34 of the fuel nozzle 30 and a second connection 78 between the support plate 74 and the ring 70 enable the support plate 74 to radially support the fuel nozzles 30 inside the cap assembly 18. The first and second connections 56, 58 may include any suitable structure known in the art for fixedly connecting components together, as previously described with respect to the embodiment shown in FIGS. 2 and 3. For example, the first and second connections 76, 78 may include weld joints between the support plate 74 and the fuel nozzles 30 and/or ring 70. Alternately, or in addition, as shown in FIGS. 4 and 5, the first and second connections 76, 78 may include bolts 80, screws, or clamps that rigidly connect the support plate 74 to a flange or lugs that extend radially from the shrouds 34 and/or ring 70. In the particular embodiment shown in FIGS. 4 and 5, the shroud 34 surrounding each fuel nozzle 30 includes a lug 82, and the ring 70 surrounding the fuel nozzles 30 includes a flange 84.

As shown most clearly in FIG. 5, the support plate 74 may include a plurality of separate support plates 74, with each separate support plate 74 extending radially inside at least a portion of the ring 70 to connect the ring 70 to at least one of the fuel nozzles 30 inside the combustor 10. Each separate support plate 74 may again be fabricated from any suitable material capable of continuous exposure to the temperatures associated with the combustor 10. For example, the support plates 74 may be machined from carbon steel, low alloy steel, stainless steel, or another suitable high strength sheet metal plate.

Figure 6:
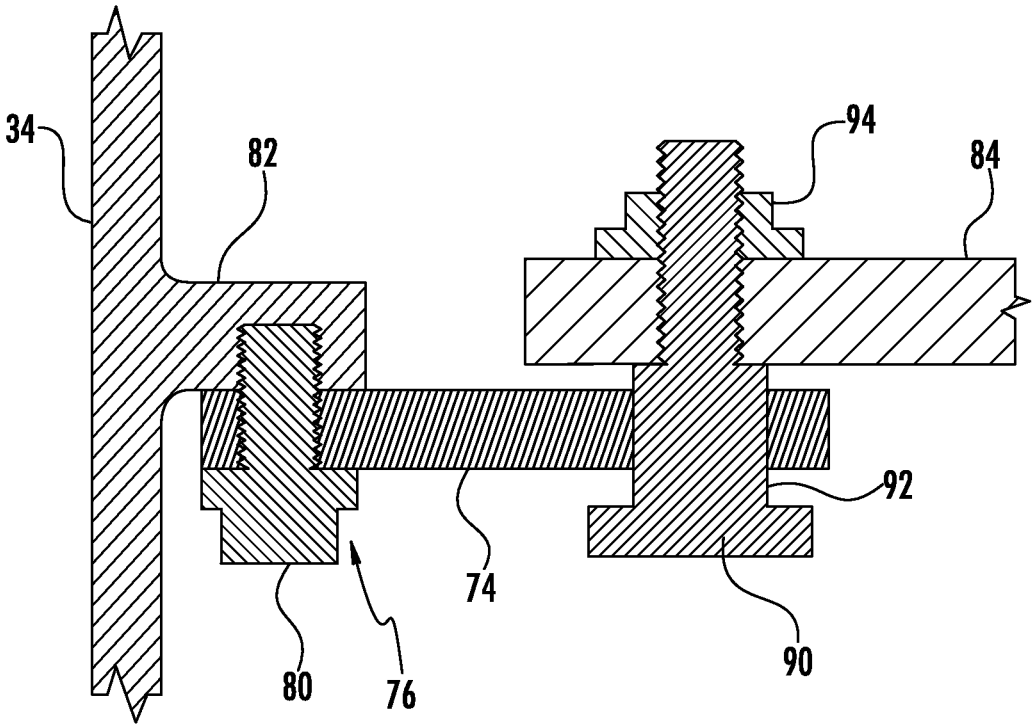
FIG. 6 is an enlarged side cross-section view of a portion of the combustor shown in FIG. 4 according to an alternate embodiment of the present invention.

With respect to both of the embodiments shown in FIGS. 2-5, the temperature of the fuel and working fluid flowing around and through the combustor 10 may vary considerably during operations, causing the casing 12 and fuel nozzles 30 to expand or contract at different rates and by different amounts. It is anticipated that the flexibility in the support plates 54, 74 will accommodate the axial movement between the casing 12, rings 50, 70, and fuel nozzles 30 caused by the thermal expansion and contraction between these components. However, additional structure between the support plates 54, 74 and the fuel nozzles 30 and/or rings 50, 70 may allow additional axial movement between these components. For example, FIG. 6 provides an enlarged side cross-section view of the first and second connections 76, 78 shown in FIG. 4 according to an alternate embodiment of the present invention. As shown, the first connection 76 between the support plate 74 and the shroud 34 may again include the bolt 80 that rigidly connects the support plate 74 to the lug 82, as previously described with respect to the embodiment shown in FIGS. 4 and 5. However, the second connection 78 may include a bolt 90 with shoulder 92 and a nut 94 that rigidly secures the bolt 90 to the flange 84. In this manner, the shoulder 92 allows the support plate 74 to slide axially in the second connection 78 to accommodate relative axial movement between the fuel nozzles 30 and the ring 70.

The embodiments shown and described with respect to FIGS. 2-6 may also provide a method for supporting the fuel nozzles 30 in the combustor 10. The method may include surrounding the fuel nozzles 30 with the ring 50, 70, connecting the support plate 54, 74 to the ring 50, 70, and connecting the support plate 54, 74 to at least one fuel nozzle 30. In particular embodiments, the method may include circumferentially surrounding each fuel nozzle 30 with the support plate 54 and/or rigidly connecting the support plate 54 to each fuel nozzle 30, as shown for example in FIG. 3. In other particular embodiments, the method may further include connecting the ring 74 to the breech end 14 of the combustor 10, as shown for example in FIG. 4. In still further embodiments, the method may include sliding the support plate 74 axially with respect to at least one of the fuel nozzles 30 or the ring 70, as shown for example in FIG. 6.

The various embodiments shown and described with respect to FIGS. 2-6 provide one or more commercial and/or technical advantages over previous combustors. For example, the combined effect of rigid connections between the fuel nozzles 30, support plates 54, 74, and ring 50, 70 may produce a higher resonant or natural frequency associated with the fuel nozzles 30 and/or cap assembly 18. The higher resonant or natural frequency allows for a larger head end 16 volume than previously provided without a corresponding increase in combustor dynamics. The larger head end 16 volume upstream from the combustion chamber 22 allows more time for the fuel and working fluid to mix prior to combustion which allows for leaner and higher temperature combustion without increasing emissions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for supporting fuel nozzles inside a combustor, comprising:

a center fuel nozzle having a centerbody and a shroud that surrounds at least a portion of the centerbody of the center fuel nozzle, wherein the shroud of the center fuel nozzle includes a first flange circumferentially spaced from a second flange, the first and second flanges of the center fuel nozzle extending radially outwardly from the shroud of the center fuel nozzle;

an outer fuel nozzle disposed radially outwardly from and adjacent to the center fuel nozzle, the outer fuel nozzle having a centerbody and a shroud that surrounds at least a portion of the centerbody of the outer fuel nozzle, wherein the shroud of the outer fuel nozzle includes a first flange circumferentially spaced from a second flange, the first and second flanges of the outer fuel nozzle extending radially outwardly from the shroud of the outer fuel nozzle;

a ring that circumferentially surrounds the center fuel nozzle and the outer fuel nozzle; and a plurality of support plates that extend radially between the shroud of the center fuel nozzle and the ring, the plurality of support plates comprising a first support plate circumferentially spaced from a second support plate, wherein the first support plate is connected to the first flange of the center fuel nozzle, the first flange of the outer fuel nozzle and to the support ring, and wherein the second support plate connects the second flange of the center fuel nozzle to the second flange of the outer fuel nozzle and to the support ring.

2. The system as in claim 1, wherein the first support plate is rigidly connected to at least one of the first flange of the center fuel nozzle, the first flange of the outer fuel nozzle and the ring.

3. The system as in claim 1, wherein the second support plate is rigidly connected to at least one of the second flange of the center fuel nozzle, the second flange of the outer fuel nozzle and the ring.

4. The system as in claim 1, wherein the first support plate is rigidly connected to the ring via a bolt.

5. The system as in claim 1, wherein the first support plate is slideably connected to the first flange of the outer fuel nozzle via a bolt with a shoulder and a nut that rigidly secures the bolt to the first flange of the outer fuel nozzle, wherein the first support plate slides axially to accommodate relative axial movement between the outer fuel nozzle and the ring.

6. The system as in claim 1, wherein the first support plate is slideably connected to the first flange of the center fuel nozzle via a bolt with a shoulder and a nut that rigidly secures the bolt to the first flange of the outer fuel nozzle, wherein the first support plate slides axially to accommodate relative axial movement between the center fuel nozzle and the ring.

7. The system as in claim 1, wherein the second support plate is slideably connected to the second flange of the outer fuel nozzle via a bolt with a shoulder and a nut that rigidly secures the bolt to the second flange of the outer fuel nozzle, wherein the second support plate slides axially to accommodate relative axial movement between the outer fuel nozzle and the ring.

8. The system as in claim 1, wherein the second support plate is slideably connected to the second flange of the center fuel nozzle via a bolt with a shoulder and a nut that rigidly secures the bolt to the second flange of the outer fuel nozzle, wherein the second support plate slides axially to accommodate relative axial movement between the center fuel nozzle and the ring.

9. A method for supporting fuel nozzles in a combustor, comprising:

rigidly connecting a plurality of support plates to a ring that surrounds a plurality of fuel nozzles, wherein the plurality of support plates are circumferentially spaced, wherein the plurality of fuel nozzles includes a center fuel nozzle and a plurality of outer fuel nozzles disposed radially outwardly from and annularly arranged about the center fuel nozzle, wherein each support plate extends from the ring between two respective outer fuel nozzles towards the center fuel nozzle;

connecting a first support plate of the plurality of support plates to a first flange of a first outer fuel nozzle of the plurality of outer fuel nozzles;

connecting the first support plate to a first flange of the center fuel nozzle;

connecting a second support plate of the plurality of support plates to a second flange of the first outer fuel nozzle of the plurality of outer fuel nozzles; and connecting the second support plate of the plurality of support plates to a second flange of the center fuel nozzle.

10. The method as in claim 9, wherein at least one support plate of the plurality of support plates is rigidly connected to the ring via a plurality of bolts.

11. The method as in claim 9, further comprising connecting the first support plate to a first flange of a second outer fuel nozzle that is circumferentially adjacent to the first outer fuel nozzle.

12. The method as in claim 10, wherein the first support plate is slideably connected to the first flange of the first outer fuel nozzle via a bolt with a shoulder and a nut that rigidly secures the bolt to the first flange of the second fuel nozzle, wherein the first support plate slides axially to accommodate relative axial movement between the first outer fuel nozzle and the ring.

13. The method as in claim 10, wherein the first support plate is slideably connected to the first flange of the center fuel nozzle via a bolt with a shoulder and a nut that rigidly secures the bolt to the first flange of the center fuel nozzle, wherein the first support plate slides axially to accommodate relative axial movement between the center fuel nozzle and the ring.

* * * * *